United States Patent [19]

Glucksman

[11] Patent Number: 4,661,683

[45] Date of Patent: Apr. 28, 1987

[54] HAIR CURLING SET

[76] Inventor: Dov Z. Glucksman, 26 Beacon St., Burlington, Mass. 02146

[21] Appl. No.: 816,836

[22] Filed: Jan. 7, 1986

[51] Int. Cl.[4] ..... H05B 1/00; A45D 2/12; A45D 4/12

[52] U.S. Cl. ..... 219/222; 132/9; 132/33 R; 219/242; 219/385; 219/521

[58] Field of Search ..... 219/222–226, 219/242, 520, 521, 385, 433; 132/33 R, 33 G, 9

[56] References Cited

U.S. PATENT DOCUMENTS

| | | | |
|---|---|---|---|
| 793,229 | 6/1905 | Rolfe | 219/385 X |
| 900,292 | 10/1908 | Meredith | 219/385 X |
| 2,119,172 | 5/1938 | Madden | 219/433 X |
| 3,410,985 | 11/1968 | Giacchero | 219/222 |
| 3,415,254 | 12/1968 | Brock et al. | 219/222 X |
| 3,585,357 | 6/1971 | Mandell et al. | 219/242 X |
| 3,586,820 | 6/1971 | Yamanaka | 219/242 X |
| 3,600,552 | 8/1971 | Tolmie | 219/521 X |
| 3,665,939 | 5/1972 | Laing | 219/521 X |
| 4,298,787 | 11/1981 | Barradas | 219/222 |
| 4,584,462 | 4/1986 | Morrison | 219/242 X |

FOREIGN PATENT DOCUMENTS

| | | | |
|---|---|---|---|
| 1965932 | 7/1971 | Fed. Rep. of Germany | 219/242 |
| 2109731 | 9/1972 | Fed. Rep. of Germany | 219/242 |

*Primary Examiner*—Anthony Bartis
*Attorney, Agent, or Firm*—John S. Roberts, Jr.

[57] ABSTRACT

A hair curler set for heating hair curling rollers includes a case accommodating a plurality of cylindrical hair curler rollers arranged in horizontal or slightly inclined parallel alignment and positioned in a row to one or both sides of an elongated heater body containing an electric resistance heater and having its longitudinal axis disposed substantially horizontally and parallel to one side of the case. The case includes cradles for positioning each of the rollers in perpendicular coaxial alignment with a respective one of a plurality of spaced apart horizontally disposed heat transfer portions on the heater body. Each roller has a metallic bottom end shaped to cooperate with the heat transfer portion of the heater body to provide a large heat transfer contact area therebetween. The case and rollers are designed so that the rollers, when positioned in the cradles, have their bottom ends elastically urged into heat-conductive contact with the heat transfer portions of the heater body.

16 Claims, 6 Drawing Figures

HAIR CURLING SET

BACKGROUND OF THE INVENTION

The invention relates to hair curling rollers and to a new way of heating them. It refers particularly to a complete set comprising a case and rollers positioned therein and to a new method of transferring heat energy from the case to the individual rollers.

A conventional hair curling set consists of a case provided with a plurality of upstanding electrically heated posts and a number of rollers, usually of different diameters, positioned on these posts to be heated to the required temperature. The rollers are usually cylindrical, provided with hair-gripping means on their circumference, and contain thermally insulated portions to allow their handling without the danger of burning the user's fingers. They are hollowed out in their bottom portion for being placed onto the posts for the sake of heat transfer from post to roller. The case is usually closed by a cover which retains the heat during warming up. Various types of rollers are on the market: there are rollers of metal and of plastic material, or rollers having a metal core or sleeve and a plastic outer shell; some rollers are provided with bristles, and others with outstanding teeth. Other kinds are filled with a heat-retaining melting liquid, but all have the common feature of being hollowed out for being placed on the heated posts.

The posts are occasionally heated individually by an electric heating element inserted into each post. This arrangement is relatively expensive and adds considerable weight to the set. In most instances, the entire bottom of the case is heated by electric resistor means and heat energy is transferred to each post mostly by convection. In this way, much heat is dissipated and heating-up takes a long time. Also, the existing hair curling sets are of excessive height due to the vertical posts and the rollers placed thereon, a fact which makes storage inconvenient, especially on a trip away from home, when modern flat suitcases are used. An example of such an arrangement is disclosed in U.S. Pat. No. 4,489,233 (Glucksman). The above drawback is overcome in the hair curling set of the present invention which has as one of its objects to provide flat cases, by placing the rollers flat on the bottom of the box containing them at the same time.

It is another object to provide the curler case with simple and inexpensive heater means which provides rapid heat transfer to the rollers; and it is a final object to permit ready withdrawal of individual rollers and their repositioning from and into the case, without any major effort.

SUMMARY OF THE INVENTION

The hair curling set of the invention consists of a container or case—preferably provided with a cover, provided with locations for positioning therein a plurality of hair curling rollers in parallel and substantially horizontal alignment. The case comprises an elongated heater body, containing electric resistance means, and provided with distanced-apart heat-transfer portions; the case further comprises resilient, releasable means adapted to press each roller onto one of the heat transfer portions of the heater body so as to effect intensive heat transfer from the heater body to each roller. Each roller consists of a metallic shell provided with external hair-gripping means, and with one metallic end shaped to cooperate with individual heat transfer portions of the oblong elongated heater body, with the aim to obtaining a large common area of heat-conductive contact.

In a preferred embodiment the case is built to house two parallel rows of rollers on both sides of the heater body and in heat-conductive contact with two rows of opposite heat transfer portions.

The heater body is generally in the shape of a flat box containing a loop of electric resistor such as a rope-heater, and provided on one or both sides with projecting knobs of various shapes, which serve as heat transfer portions and mate with the bottom portions of the rollers to be heated. The knobs may be planar so as to mate with the flat end of each roller, or they may be of hemispherical or frustoconical shape so dimensioned as to readily cooperate with corresponding recesses in the bottom ends of the rollers.

The rollers, which are of metal, have their top ends usually closed by a plastic cover which permits handling of the roller and protects the hand from contact with the metallic, heated portions. Most rollers are likewise fitted with a plastic ring at their bottom end, similarly serving for their handling without the danger of contact with the hot metal portions.

A modification includes a metal shell covered over its entire length by a plastic case from which project spikes or teeth as hair gripping means.

The case may contain spring means serving to press onto the tops of the rollers and to urge their bottom ends into firm contact with the heater portions of the heater body. Another possibility is to utilize the cover of the case to press onto the roller tops, in closed state, and thus to urge them toward the heater.

Still another possibility is to have the inner portion of the case, adjacent the tops of the rollers, included in such a manner that downward pressure of the case cover on the rollers urges them onto the heater portions.

SHORT DESCRIPTION OF THE DRAWINGS

SPECIFIC DESCRIPTION OF THE INVENTION

Figure 4:
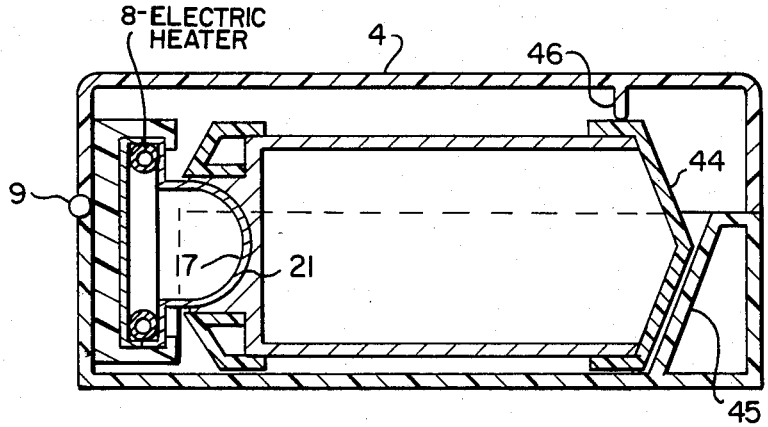
FIG. 4 is a cross section through a case containing one row of rollers, showing another manner of urging each roller onto the heater body.
Figure 5:
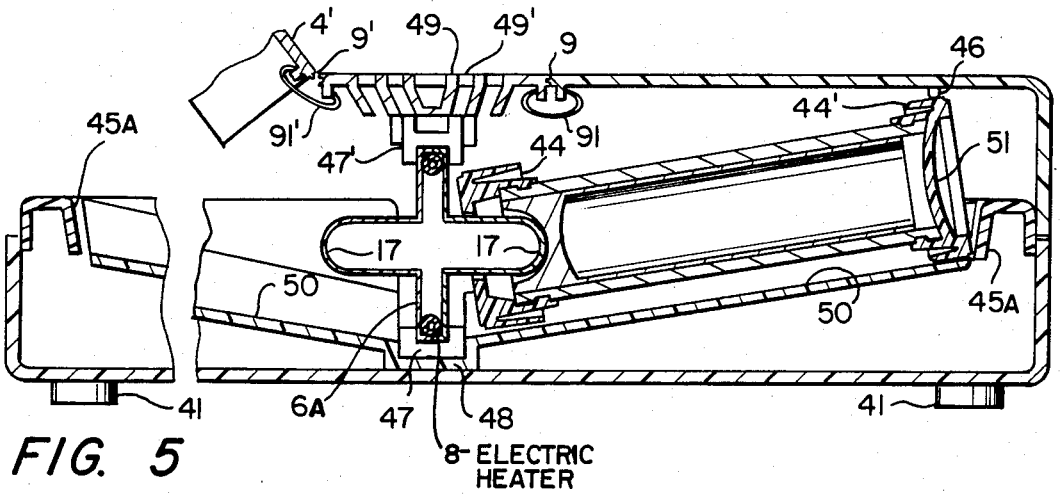
FIG. 5 is a cross section through a modified case containing two rows of rollers and through a roller provided with a recessed plastic cap.
Figure 6:
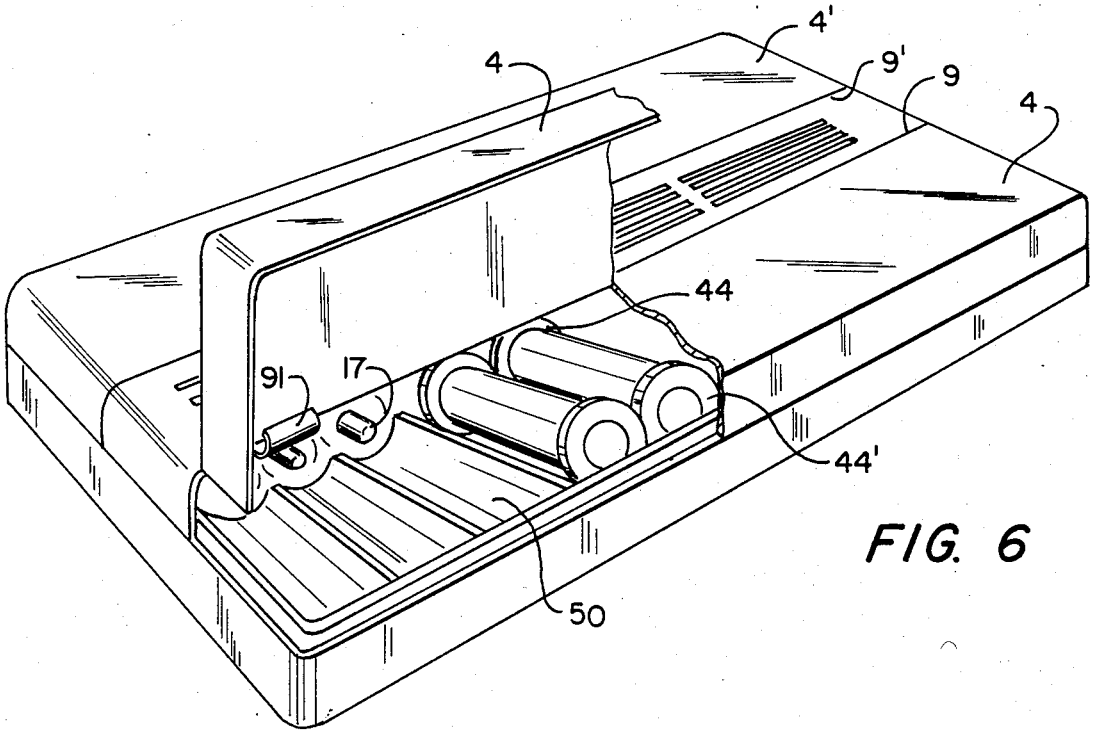
FIG. 6 is a perspective view of a case containing two rows of rollers aligned on both sides of a heater body.

One embodiment of the curler set of the present invention is illustrated in FIG. 6. In general, curlers 44 are positioned side-by-side in a cradle 50 constructed to push or position the curlers against a heating element 17. FIGS. 1–5, described in more detail below, illustrate the present invention in terms of various embodiments which represent the present invention. In general, the present invention is a compact curler case containing at least one row of curlers, and containing an improved heat transfer system. The heat transfer system comprises spaced-apart heat transfer portions (of different designs as represented in FIGS. 1–5) which protrude from an elongated heater body, and which mate with a corresponding roller. The roller is urged into the protrusions by the slope of the cradle and/or a variety of designs located at the end of the cradle opposite the heater body.

The heat transfer portions may be rectangular or cylindrical flat-faced knobs (FIG. 1), hemispherical (FIG. 2), frusto-conical (FIG. 3), or elongated versions of any of the above (FIG. 5). It is not intended, however, that the design of the protrusion should be limited to the designs illustrated.

The shape of the roller may also vary, depending on its end use. In the preferred embodiment, the roller body is cylindrical or rectangular, and may or may not contain spikes, teeth, or short fibers radiating from the sides of the roller. Several embodiments of the roller shape are shown in U.S. Pat. Nos. 4,548,218 and 4,382,447, and 4,569,360 (Glucksman).

The means of pressing the roller against the heat transfer protrusions may also exhibit design variations within the scope of the invention. The roller may be pushed against the heat transfer portion by a strip of foamed plastic or similar material (FIG. 1), rings (FIG. 2), a leaf spring (FIG. 3) or sloping surface (FIGS. 4 and 5). In each of these designs, the cover may assist in pushing the roller against the heat transfer portion (see, particularly, FIGS. 4 and 5).

Figure 1:
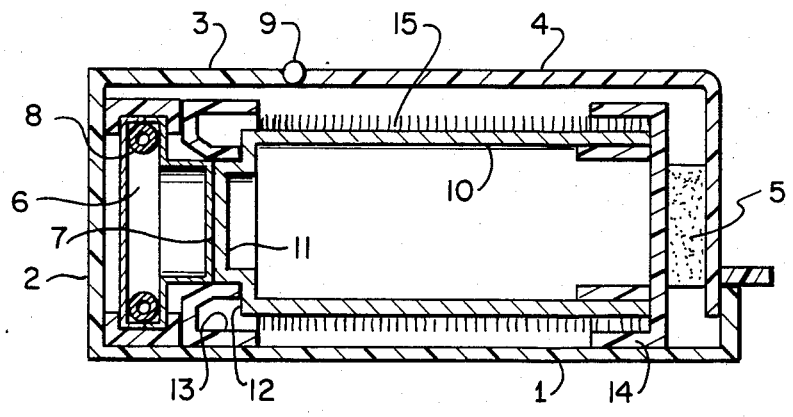
FIG. 1 is a cross section through a case containing one row of rollers, and a longitudinal section through one of the rollers.

FIG. 1 shows a rectangular case consisting of a bottom 1, a rear wall 2 and a top 3, the latter covering about ¼ of the interior and leaving a large portion of the top and the front open for handling the rollers positioned in the case. This opening is closable by a lid or cover 4 which covers the open top portion and the open front portion, and is hinged to the case top by a hinge 9. A strip of foamed plastic material 5 is fastened to the inside of the front portion of the cover which serves to press onto the heads of the rollers when the cover is in a closed position. An elongated heater body 6 is positioned in the rear part of the case extending along the entire length of the rear wall. It comprises protruding cylindrical, flat-faced knobs 7, one knob for each roller to be heated, and encloses a loop of an electric resistor 8, such as a rope heater, the latter having its terminals connected to a switch (not visible in the drawing).

Each roller consists of a metal cylinder 10 which is closed at its bottom end in the shape of a flat circular protrusion 11 of a size corresponding to the diameter of the knobs 7 on the heater body 6; a circular recess 12 is formed around this protrusion and accommodates a ring 13 of a thermally insulating material, which serves to locate the roller exactly on the knob 7 and to protect the fingers of the user against burns. The open front end of the roller is closed by a cylindrical cap 14, of similar diameter as the ring 13. It serves to support the roller on the case bottom and protects the user's fingers. The roller depicted in this drawing is shown to be coated with short nylon fibers 15 on radiating from its outside which, in a known manner, assist in gripping the strands of hair wound around it.

Figure 2:
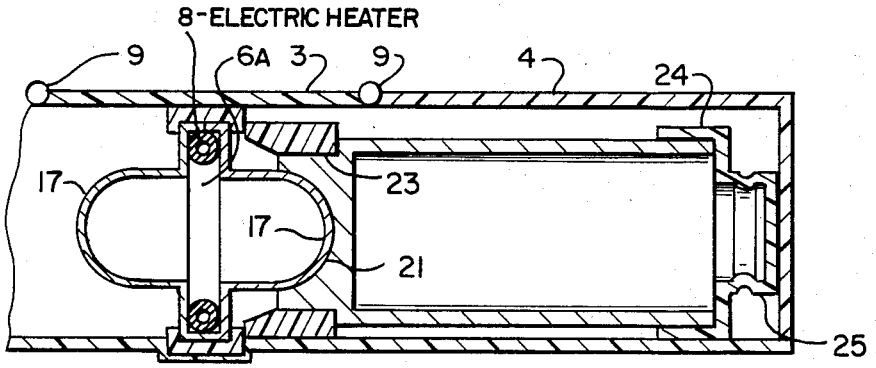
FIG. 2 is a part section through a case containing two rows of rollers and through a roller of modified configuration.

The embodiment illustrated in FIG. 2 shows a twin case, permitting two rows of rollers to be positioned on opposite sides of the elongated heater body 6A. Only one side, however, is shown complete with rollers positioned on the case bottom. The case is similar to that illustrated in FIG. 1, however, of double the width in order to accommodate the two rows of rollers, and is provided with one hinged cover 4 at each end. The set is characterized by knobs 17 on both sides of the heater body, formed with hemispherical ends which mate with hemispherical recesses 21 in the metallic bottom portions of the rollers. Ring 23 is fitted around the bottom portion serving as a handgrip and to center the roller in the semicircular trough, defined by the bottom of the casing and dividing walls. The plastic cap 14 of the embodiment of FIG. 1 is somewhat modified; it appears in the shape of a cap 24 made of an elastomer and provided with a compressible central protrusion 25. As can be gleaned from the drawing the protrusion is compressed by the closed case cover 4, thus, pressing the roller ends onto the appropriate knobs 17 of the heater body. Compared with the flat contact surfaces of heater and roller as shown in FIG. 1, the hemispherical contact faces provide a larger heat-transfer surface, also ensuring perfect contact even if the rollers are slightly misaligned.

Figure 3:
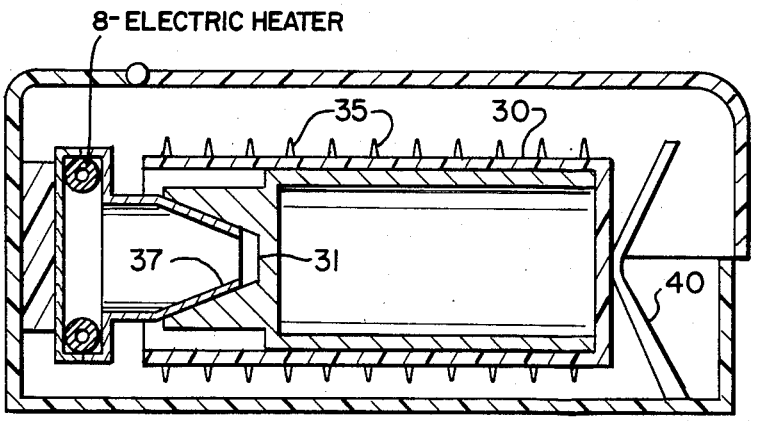
FIG. 3 is a cross section through a case housing one row of rollers, showing spring means adapted to press onto the roller heads.

The embodiment shown in FIG. 3 comprises a case designed for one row of rollers, similar to that shown in FIG. 1. Instead of the flat contact faces between heater and roller, the present embodiment shows male and female frusto-conical shapes of the knobs 37 on the heater body and of the recesses 31 in the roller ends. Their function is similar to that of the corresponding parts shown in FIG. 2, i.e., larger heat transfer area, better fit and perfect centering. A modification of the roller is also expressed by a cylindrical, plastic sleeve 30 covering the entire length of the metal cylinder as well as the open front end of each roller, the sleeve being provided with outstanding spikes or teeth 35 serving to better grip the hair, and to keep the user's fingers away from the hot barrel.

A leaf spring 40 extends along the front end of the case and urges the rollers onto the knobs 37 for increased heat transfer. The cross section of the leaf spring comprises an inclined top portion facilitating insertion and withdrawal of individual rollers.

The embodiment illustrated in FIG. 4 is in its main parts identical with that shown in FIG. 2, the difference being in the manner of urging the rollers toward the heater body. Herein the knobs and the roller bottoms are in respectively male and female, hemispherical shape; however, the top end of the roller is covered by a conical cap 44, while the front end of the case is shaped to form an inwardly sloping surface 45 in contact with the cap 44. A downward-extending ledge 46 is formed on the inside of the cover 4 which, in closed state of the cover, presses down on the sides of the rollers close to their top ends. This pressure forces the rollers to slide down along the sloping surface 45 and thus to be urged into close contact with the knobs 17 of the heater body.

FIG. 5 illustrates yet another embodiment of a twin-case hair-setter according to the invention. The heating body 6A with its spherical ended knobs 17 is being supported by two supports 47 and 47′, the lower support 47 being firmly held in the casing of the setter 48, whereas the upper support 47′ is secured by a vented bridge 49. The longitudinal vents 49′ in this bridge allow hot air from the heating unit to escape to avoid overheating of the closed case. The case comprises a plurality of cradles 50, each of semi-circular cross-section corresponding to the diameters of the roller caps 44 and 44′. The end of each cradle furthermost from from the heating body 6 is in the shape of a sloping wall 45A, attached to the casing wall but separate from the side walls of the cradles 50, to allow it to flex. When a roller is placed in the cradle 50 it automatically becomes aligned with the center of the knob 17, when it is subsequently being pushed down by the user or by the rib 46 in the lid 4. The rear wall 45A of the cradle flexes and forces the roller against the knob 17 to effect a good contact and rapid heat transfer. The rear cap 44' of the roller is provided with a recess 51 to assist in the removal of the rollers by lifting the backs with a finger tip. Hinges 9 and 9' are provided with clips 91 and 91' which are bi-stable, namely they will allow the cover to rest in either of two positions. The cover 4 is shown in its closed position whereas the cover 4' is shown in its open position.

The hair setter or case is supported above the resting surface by integral feet 41; it is also provided with a switch, a power cord and temperature controlling and limiting devices not shown in this picture.

FIG. 6 shows a twin case of FIG. 5 filled with rollers on both sides of a heater body. The rollers are in slightly inclined position, from a low level in the center of the case to a higher level at both ends, in contradistinction to the embodiments of FIGS. 1 to 4; however, it has been proved that this position slightly assists in withdrawing and replacing of the rollers from and into the case. The two covers 4 are of transparent material and one portion is shown in open position for use of the rollers.

The advantages of the curler set of the invention are primarily the compactness of the case, and secondly the improved heat transfer from heater body to the rollers, resulting in quicker warming-up. Another important feature is the low cost of manufacture due to the simple design of the heater body, compared with the cost of the hitherto used posts engaging with hollow rollers.

I claim:

1. A hair curler set adapted for heating a plurality of hair curling rollers by electric resistance means comprising:

a case containing an elongated heater body having its longitudinal axis disposed substantially horizontally and extending parallel to one side of said case and locating means in said case for positioning a plurality of rollers in parallel and substantially horizontal alignment perpendicular to the axis of said heater body, said heater body being provided with electric resistor means and with a plurality of spaced-apart substantially horizontally disposed heat-transfer portions, each in substantial coaxial alignment with a different one of the curlers positioned by said roller locating means, a plurality of rollers, each roller having a top and bottom and positioned in said case with its bottom adjacent to a respective one of said heat-transfer portions, each said roller consisting of a cylindrical metal shell and a metal bottom end so shaped as to cooperate with said heat-transfer portions to effect a large common contact area therebetween;

elastic means associated with said said case and acting on the top portions of said rollers and adapted to urge their bottom ends into heat-conductive contact with said heat transfer portions of said heater body.

2. The hair curler set of claim 1 wherein said case is adapted to house one row of parallel aligned rollers and said heater body has heat-transfer portions protruding from the side facing said row of rollers.

3. The hair curler set of claim 2 comprising a case closable by a hinged cover, said cover being provided with means adpated to urge said rollers toward said heat transfer portions, in closed state of said cover.

4. The hair curler set of claim 3 comprising a case includes an inclined surface facing the top of said rollers and a ledge attached to the inside of said cover is adapted to urge said rollers downwards on said inclined surface to effect heat-conducitve contact between said roller bottoms and said heat-transfer portions of said heater body.

5. The hair curler set of claim 4 wherein said inclined surface facing the tops of said rollers is resiliently attached to the side wall of said case and forms said elastic means so as to give way upon insertion of a said roller, and to urge said roller toward one of said heat transfer portions of said heater body.

6. The hair curler set of claim 3 wherein said hinged cover is provided with a strip of a foamed plastic material attached to the inside of said cover and forming said elastic means, serving to press down on the tops of said rollers in closed state of said cover.

7. The hair curler set of claim 3 wherein each of said roller has its top end covered by a compressible cap, adapted to be compressed by said cover in closed state.

8. The hair curler set of claim 1 wherein said case is adapted to house two rows of parallel aligned rollers on opposite sides of said heater body, which heater body is provided with heater-transfer portions on both of said opposite sides.

9. The hair curler set of claim 1 wherein said heater body is provided with sideways protruding planar heat transfer portions, and said rollers have a flat bottom end.

10. The hair curler set of claim 1 wherein said heater body is provided with sideways protruding hemispherical heat transfer portions, and said rollers have a bottom end recessed in corresponding hemispherical shape.

11. The hair curler set of claim 1 wherein said heater body is provided with sideways protruding heat transfer portions of male frusto-conical shape, and said rollers have a recessed bottom end in corresponding female frusto-conical shape.

12. The hair curler set of claim 1 wherein said rollers are closed at their top by a cap made of a plastic material.

13. The hair curler set of claim 12 wherein said plastic cap closing the top end of each said roller is centrally recessed to permit its ready lifting by a finger.

14. The hair curler set of claim 12 wherein said case has an openable cover and said plastic cap is compressible and forms said elastic means, said compressible cap is adapted to be compressed by said cover in its closed state.

15. The hair curler set of claim 1 wherein said rollers are each provided with a ring of a plastic material mounted around its bottom end.

16. The hair curler set of claim 1 wherein said rollers are provided with hair-gripping means on their cylindrical shells.

* * * * *